United States Patent [19]

Tanaka

[11] 4,235,588

[45] Nov. 25, 1980

[54] CIGARETTE LIGHTER UTILIZING CATALYST

[75] Inventor: Noboru Tanaka, Tokyo, Japan

[73] Assignee: Tokyo Pipe Co., Ltd., Tokyo, Japan

[21] Appl. No.: 857,087

[22] Filed: Dec. 5, 1977

[30] Foreign Application Priority Data

Jan. 13, 1977 [JP] Japan ..... 52/2743
Feb. 4, 1977 [JP] Japan ..... 52/11252

[51] Int. Cl.[3] ..... F23Q 25/00
[52] U.S. Cl. ..... 431/147; 431/268
[58] Field of Search ..... 431/147, 326, 268, 267, 431/276, 277, 327

[56] References Cited

U.S. PATENT DOCUMENTS

| | | | |
|---|---|---|---|
| 2,243,539 | 5/1941 | Schmitt et al. | 431/147 |
| 2,444,956 | 7/1948 | Schmitt | 431/147 |
| 2,489,620 | 11/1949 | Cartwright | 431/147 X |
| 2,497,937 | 2/1950 | Florman | 431/147 |
| 3,299,675 | 1/1967 | Laffitte et al. | 431/147 X |

*Primary Examiner*—Carroll B. Dority, Jr.
*Assistant Examiner*—Larry Jones
*Attorney, Agent, or Firm*—Eyre, Mann, Lucas & Just

[57] ABSTRACT

When a cap of a cigarette lighter is opened, fuel is mixed in a gasified state with externally drawn air, and the resultant mixture of air and gasified fuel is supplied to a catalyst within the lighter body for causing natural combustion of the mixture by the oxidizing action to elevate the temperature of the air-fuel mixture to the ignition point so as to bring about ignition.

11 Claims, 13 Drawing Figures

CIGARETTE LIGHTER UTILIZING CATALYST

Prior art cigarette lighters have required ignition means for ignition such as a piezo-electric element, a battery, a flint or the like. In accordance with the present invention, ignition is obtained by utilizing the oxidizing action of a catalyst, so that there is no need for separately providing a mechanical ignition means as in the prior art. The applicants have also found that it is possible to obtain an optimum ignition state by altering the structure and combination of the catalyst in accordance with the type of fuel. Further, by sufficiently gasifying the fuel obtained from the fuel tank within the lighter before mixing with the drawn in air, sufficient oxidizing reaction in the catalyst can be obtained to bring about ignition.

When the lighter is out of use, the catalyst is preferably isolated from the outside, thereby reducing its contact with air to extend its service life. Furthermore, the issuing of fuel to the nozzle section and the drawing in of air from the outside of the lighter are interlocked with an openable cap which prevents accidental ignition when the cap is closed thereby permitting the lighter to be safely carried and used.

Accordingly, an object of the invention is to provide a cigarette lighter in which the oxidizing action of a catalyst causes natural combustion of a gas-air mixture to obtain ignition.

Another object of the invention is to provide a cigarette lighter in which fuel is first gasified and then mixed with forcibly drawn in air, with the resultant air-fuel mixture being oxidized by the catalyst to cause natural combustion so as to obtain ignition.

A further object of the invention is to provide a cigarette lighter in which optimum ignition can be obtained by altering the construction and combination of the catalyst according to the type of fuel.

A still further object of the invention is to make it possible to extend the service life of the catalyst by isolating the catalyst from outside air during non-use of the lighter.

A yet further object of the invention is to prevent accidental ignition during non-use of the lighter by an arrangement wherein the supplying of fuel and the mixing with air from outside cannot be accomplished when the lighter cap is closed.

The above and other features, objects and advantages of the invention will become more clear from the following description when the same is read in conjunction with the accompanying drawings, in which.

DETAILED DESCRIPTION OF THE PREFERRED EMBODIMENT

Figure 1:
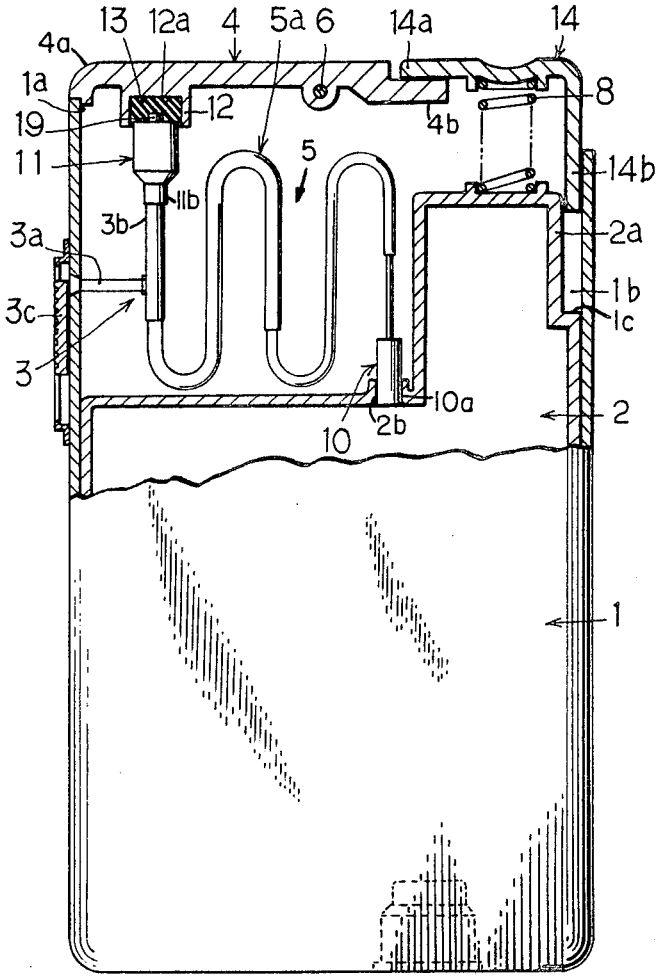
FIG. 1 is an elevational view, in partial section, showing an ignition mechanism within a body of a cigarette lighter according to the invention.

Referring to FIG. 1, there is shown a fuel tank 2 in the interior of and secured to a lighter body 1. It is, of course, possible to use the lighter body 1 itself as the fuel tank 2 as, for example, by providing a partition member in an upper portion of the body 1. A fuel supply cylinder 10 has its lower end 10*a* sealably mounted in a delivery port 2*b* in the fuel tank 2. A duct 5 having a plurality of U-shaped portions 5*a* is connected at one end to the fuel supply cylinder 10 and at the other end to the lower end 11*b* of a funnel-like catalyst holder 11.

The upper end of a nozzle 19 projects from the center of the top of the catalyst holder 11. A lighter cap 4 abuts the ignition nozzle 19 and has a lower projection 12 formed with a recess 12*a*, which is filled with a heat-resistant seal member 13 such as heat-resistant rubber, asbestos or the like. When the cap 4 is closed, the nozzle 19 and catalyst holder 11 are sealed together to prevent natural oxidation of the catalyst.

The cap 4 is pivoted on a fulcrum member 6 to raise end 4*a* of the cap 4 from the lip 1*a* of the body 1. The end 4*a* of the cap is adapted to be in engagement with the lip 1*a* of the body 1 when the lighter is not in use, and its other end 4*b* is adapted to be in contact with the actuating portion 14*a* of a push member 14.

The push member 14 consists of an L-shaped member having an actuating portion 14*a* and a guide portion 14*b*. A spring 8 is interposed between the actuating portion 14*a* and the top of an extension 2*a* of the fuel tank 2. When the push member 14 is urged against the force of the spring, its guide portion 14*b* is vertically moved through a gap 1*b* between the fuel tank 2 and the inner periphery of the lighter body 1. Also, as the actuating portion 14*b* is downwardly depressed, the cap 4 is rotated in clockwise direction, thus releasing the seal between the nozzle 19 and seal member 13. The push member 14 has a stop mechanism such as abutment surface 1*c* to stop the rotation of the cap.

An air supply means 3 is provided with a movable finger plate 3*c* for opening and closing the open end of an air supply duct 3*a* for supplying air to the fuel duct 5.

Figure 2:
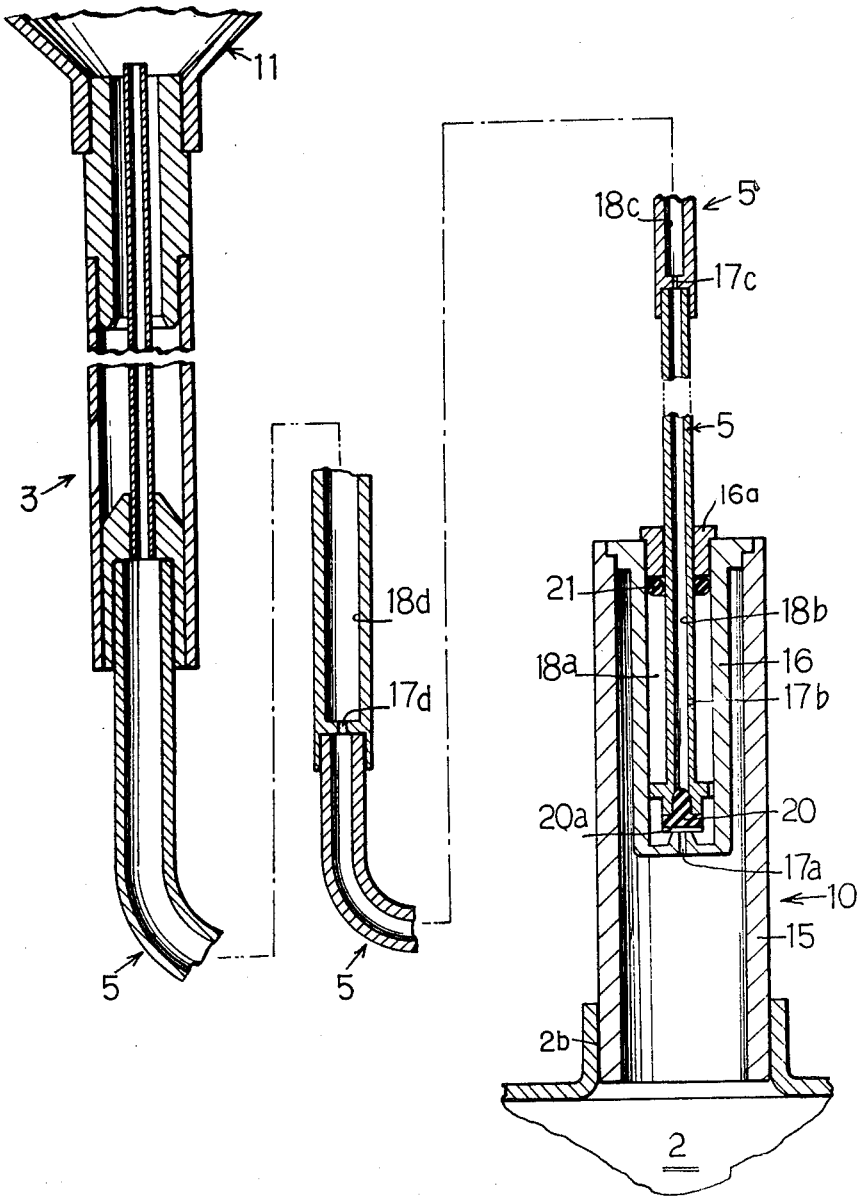
FIG. 2 is a fragmentary sectional view showing the fuel duct from fuel tank to catalyst of FIG. 1.

FIG. 2 shows the connection of the fuel duct 5 between the fuel supply cylinder 10 and catalyst holder 11. The fuel supply cylinder 10 has an outer tube 15 extending upward from the delivery port 2*b*. An inner tube 16, concentrically located inside outer tube 15, has a first small hole restricting section 17*a* in its lower end, and a cap cylinder 16*a* secured in its upper end. The lower end of the fuel duct 5 passing through the center of the cap cylinder 16*a* is sealed at its inner end by a resilient plug 20. The resilient plug 20 is adjacent the small hole restricting section 17*a*.

The plug 20 is provided at its lower end with a thin lateral groove 20*a*, forming an extension of the small hole restricting section 17*a* to enable the passage of gas into the expanding section 18*a* within the inner tube 16. An O-ring 21 prevents leakage of fuel around the duct 5 into the interior of the lighter.

The portion of the fuel duct 5 which is contained within the inner tube 16 has a small hole restricting section 17*b* passing through its side wall communicating with the expanding section 18*a*. A plurality of fuel ducts 5 are provided with each fuel duct 5 including a U-shaped portion with small hole restricting sections or orifices 17*c*, 17*d*, . . . formed at its beginning. Each succeeding duct 5 acts as an expanding section 18*a*, 18*b* . . . for the small hole restricting section which precedes it. In order to permit continued expansion of the gas as it passes through the duct 5, each succeeding expansion section 18*b*, 18*c* . . . is provided with a progressively larger inner diameter. The orifices 17*c*, 17*d*, . . . may also be progressively increased in diameter. Thus, the fuel supplied from fuel tank 2 to the fuel duct 5 through the fuel supply cylinder 10, gasified through the small hole restricting sections 17*a*, 17*b*, . . . and expanding sections 18*a*, 18*b*, . . . and then led through an air supply means 3 secured to the end of the duct 5 to a catalyst 11 where the gasified fuel is naturally ignited upon reaching its combustion point due to the oxidizing effect of a catalyst.

The air supply means 3 is adjustable to control the fuel supply so that the oxidizing can be controlled.

Figure 3:
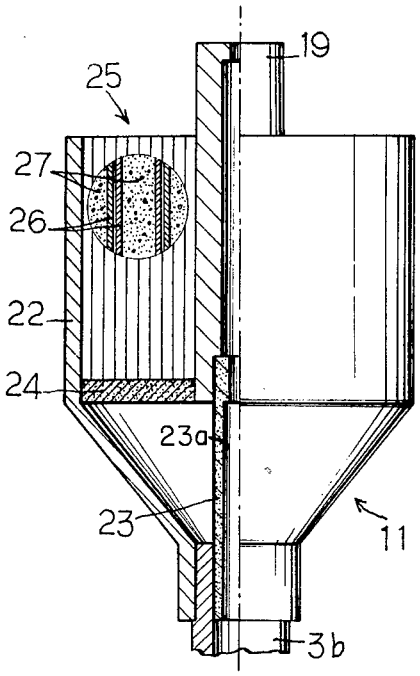
FIGS. 3 to 6 show various examples of the catalyst in the embodiment of FIG. 1.

FIG. 3 shows one embodiment of the catalyst 11 suitable for use in the lighter shown in FIG. 1. A catalyst cylinder 22 contains the catalyst 25. The lower end of the catalyst cylinder 22 is connected to the air supply means 3. A nozzle 19 is disposed in the center of the catalyst cylinder 22, and a porous cylinder 23 is mounted between the lower end of the nozzle and air supply means 3. A portion of the gasified fuel from the fuel duct 5 passes through the wall of the porous cylinder 23 and thence passes through a gas permeable porous or perforated member 24 such as a metal net to be led to a catalyst group 25. The remainder of the gasified fuel continues through the channel 23*a* in the porous cylinder 23 to the nozzle 19.

The catalyst group 25 includes a number of upright heat-resisting glass pipes 26 filled with powdery catalyst 27. The gasified fuel is oxidized upon coming in contact with the powdery catalyst 27 in the catalyst group 25 so that its temperature is elevated to the flash point thus producing flame in the neighborhood of the nozzle 19. The flame ignites the main fuel issuing from the nozzle 19.

Figure 4:
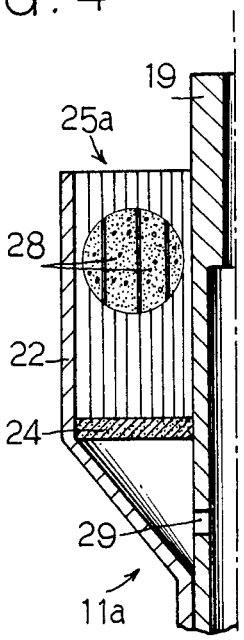

FIG. 4 shows another example of the catalyst holder 11*a*, in which a catalyst group 25*a* within the cylinder 22 consists of a number of rods 28 extending upright from a gas permeable porous body 24. The rods 28 are formed by solidifying the powdery catalyst. The lower end of nozzle 19 is connected to the upper end of a fuel tube 3*b*. Optionally, the fuel tube 3*b* and nozzle 19 may be made in one piece. A small hole 29 in the wall of the nozzle 19 below the porous body 24 diverts part of the fuel to the catalyst group 25*a* so as to produce flame.

Figure 5:
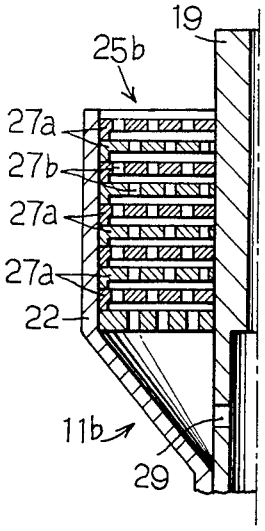

FIG. 5 shows a further embodiment of the catalyst 11*b*. Here, a catalyst group 25*b* is formed by stacking a number of flat catalyst plates in a number of stages around a nozzle 19 extending in the center of the interior of a cylinder 22. Each catalyst plate 27*a* is disc shaped and contains a number of small holes 27*b* through the plate 27*a*. The small holes 27*b* of each plate 27*a* are staggered with respect to those of the adjacent plate. The retention period of the gasified fuel is thus extended and the oxidizing action is increased.

The remaining functions of the apparatus are similar to that shown in FIG. 4.

Figure 6:
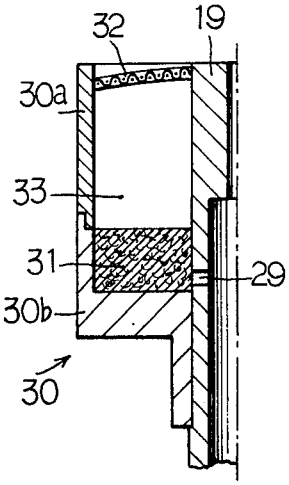

FIG. 6 shows a further embodiment of the catalyst. A cylinder 30 replaces the funnel-like cylinder 22 shown in FIGS. 3 to 5. The cylinder 30 consists of an upper cylinder 30*a* and a lower cylinder 30*b*. A fiber-like or cotton-like catalyst 31 is provided in the lower cylinder 30*b* and a net-like catalyst 32 is provided near the opening of the upper cylinder 30*a* defining a space 33 between them. Some of the gasified fuel is led through a lateral hole 29 provided in the nozzle 19 to the catalyst layer 31. Heating of the gas to the flash point is performed as previously described.

In all of the above embodiments, the container holding the catalyst is removable and facilitates the replacement of the catalyst.

Any suitable fuel adapted to exothermic reaction in the presence of a catalyst may be used. Organic hydrocarbons such as methanol, butane, propane and so forth, and also inorganic oxides and plant oil such as colza oil are preferred.

Figure 7:
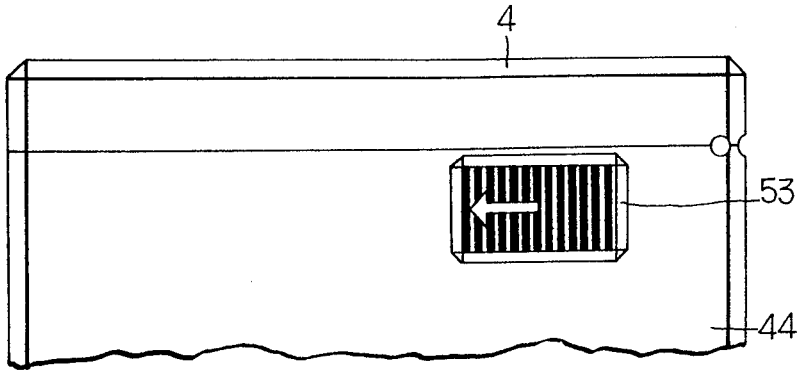
FIG. 7 is a view showing an operating knob for opening and closing a lighter cap.
Figure 8:
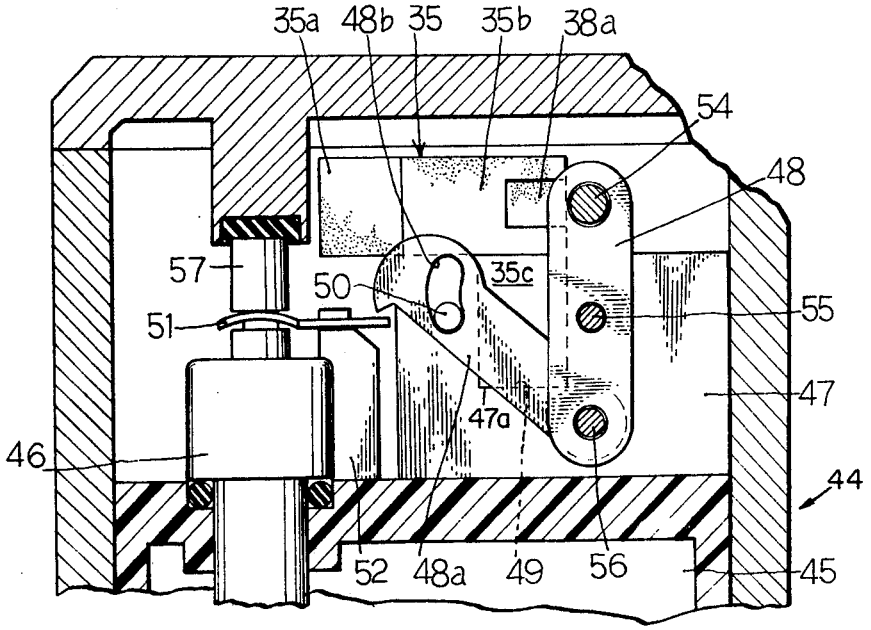
FIG. 8 is a fragmentary upper sectional view showing inner parts of another embodiment of the cigarette lighter according to the invention.
Figure 9:
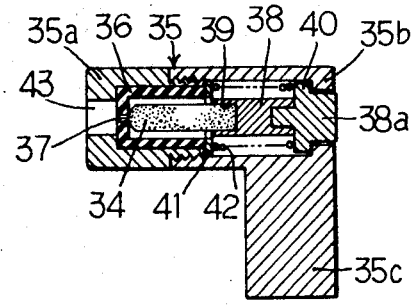
FIG. 9 is a fragmentary sectional view showing the catalyst holder of FIG. 8.

Referring now to FIGS. 7 to 9, a catalyst 34 formed into a rod is moveably contained in a holder 35. An elastic cylinder or membrane 36 having an opening 37 formed at one end is disposed within the holder 35 surrounding the catalyst rod 34. The catalyst rod 34 has its front end facing the opening 37 and its rear end in a recess 39 in a push rod 38. The push rod 38 is provided with a flange 40. The rear end of the flange 40 forms an auxiliary push rod 38*a* projecting slightly outward from the holder 35. A spring 42 between the flange-like projection 40 and a disc 41 held at the rear end of the elastic cylinder 36 and a threaded cylinder 35*a* urges the catalyst rod 34 rearward to maintain it in the retracted position shown. The main body 35*b* of the holder 35 includes a downwardly extending mounting portion 35*c*.

The threaded cylinder 35*a* has an opening 43, through which the catalyst rod 34 may be pushed. Force on the auxiliary push rod 38*a* against the spring force of the spring 42 moves the catalyst rod 40 forward forcing open the opening 37 of the elastic cylinder 36 and extending the catalyst rod 40 through the opening 43.

An upright wall portion 47 extends from the top of the fuel tank 45 facing a nozzle duct 46. The mounting portion 35*c* of the catalyst holder 35 is removeably fitted in a depression 47*a* formed in an upright wall portion 47 of the fuel tank.

A main rod 48 of an operating mechanism for simultaneously effecting the delivery of the catalyst and for providing a supply of gas is also mounted on the upright wall portion 47. The operating mechanism comprises a main rod 48 and an inclined arm rod 48*a* pivoted to the main rod 48 by a pivot 56 at one of its ends and having a window 48*b* formed adjacent its other end. A rod 50 is loosely fitted in the window 48*b*.

A lever 51, mounted on top of a support post 52, is adapted to rotate thereabout. The top end of the main rod 48 of the operating mechanism is pivoted to a pin 54 extending from the back side of an operating knob 53 mounted on the upper surface of the body 44, as shown in FIGS. 7 and 8. The pin 54 is in contact with the end of the auxiliary push rod 38*a* of the catalyst holder 35. The operating knob 53 is movable in the direction of arrow.

The main rod 48 is centrally pivoted about a pin 55 on the upright wall portion 47. When the operating knob 53 is moved in the direction of arrow, the main rod 48 is pivoted about the pin 55 causing the rod-like catalyst 34 within the holder 35 to project outward from the opening 43 over the top of the nozzle duct 46. At the same time, the inclined arm rod 48*a* is lowered along the pin 50 so that its tip presses down on the rear end of the lever 51. The tip of the lever raises a fuel spray tube 57 in the nozzle tube 46, whereby fuel is ejected into contact with and oxidized by the rod-like catalyst 34 to produce flame for igniting a cigarette.

Figure 11:
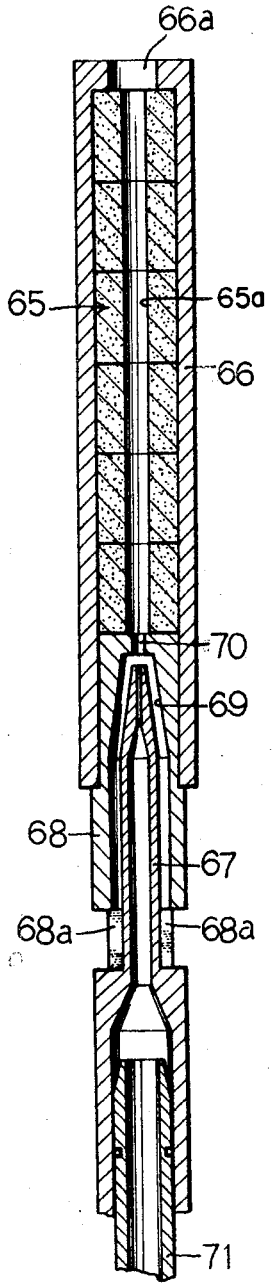
FIG. 11 is a fragmentary sectional view showing the fuel duct from fuel tank to catalyst of FIG. 10.
Figure 10:
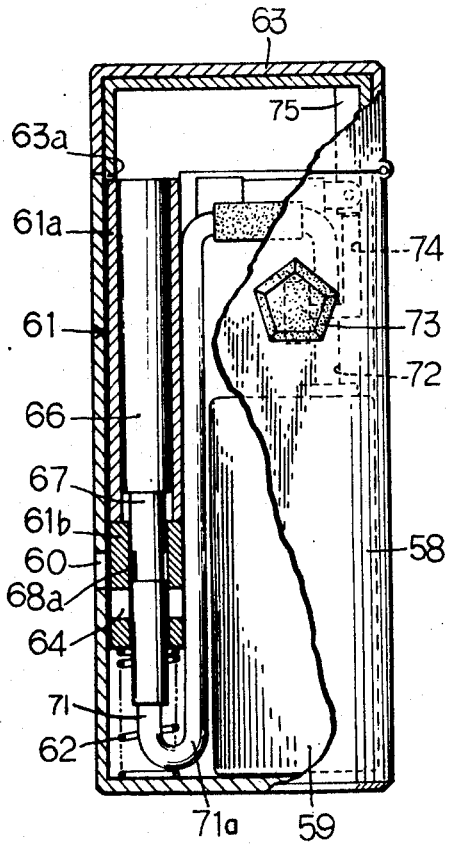
FIG. 10 is side elevation, partly broken away, showing an ignition mechanism within the body of a cigarette lighter according to the invention.

Referring now to FIGS. 10 and 11, a fuel tank 59 is disposed in the interior of a lighter body 58. One wall of the body 58 contains an air supply window 60 therethrough. An elongated outer cylinder 61 consisting of upper and lower cylinders 61*a* and 61*b* joined together in the axial direction is disposed in the interior of the lighter body 58 adjacent the air supply window 60. The outer cylinder 61 is urged upward by a coil spring 62. When the lighter is not in use, the outer cylinder 61 is held downward against the spring force of the spring 62 by an inward projection 63*a* from a cap 63 hinged at one end to the body 58. The lower cylinder 61*b* of the outer cylinder 61 is provided with an air hole 64, positioned such that it is brought into communication with the air supply window 60 when the outer cylinder 61 is moved upwardly by the restoring force of the coil spring 62. The outer cylinder 61 contains an inner cylinder 66, which in turn contains catalyst 65 in the form of a number of short cylinders disposed one over another and is connected at the lower end to a nozzle tube 67 which is connected without receiving the spring force of the coil spring 62.

The catalyst 65 consists of a plurality of cylindrical catalyst layers separable from one another and each having its own central hole 65*a* serving as reaction path for the gas mixture.

The upper end of the inner cylinder 66 forms a nozzle 66*a*. The lower end of the inner cylinder is connected to a cylinder 68 serving to hold the catalyst layer 65 in place. The cylinder 68 has a notch 68*a* near its lower end and contains a nozzle tube 67 loosely fitted within it to form a gap 69 communicating with the upper catalyst layer 65 through the communication hole 70.

The notch 68*a* is open and aligned with the air hole 64 of the lower cylinder 61*b* when the cap 63 is open. Thus air is admitted through air supply window 61, air hole 64 and notch 68*a* to the gap 69. This communication is cut when the cap 63 is closed by the lowering of cylinder 61*b*. The lower end of the nozzle tube 67 is connected to one end of a long duct 71, and includes a U-shaped bent portion 71*a* for gasifying the fuel. The upper end of the nozzle tube 67 is connected to a gas jet nozzle 72*a*.

An operating knob 73 is mounted on the surface of the lighter body 58. When the operating knob 73 is operated upwardly, fuel from the fuel tank 59 passes through the gas jet nozzle 72, is gasified in the duct 71 and issues from the nozzle tube 67 into the central hole 65*a* in catalyst layer 65. Air at the tip of the nozzle tube 67 is subjected to venturi action due to the high gas speed. The air is moved upward through the communication hole 70 thus creating a partial vacuum in the interior of the gap 69. Additional air is thus drawn in through the air supply window 60. The mixture of air and fuel gas is passed through the catalyst layer 65 to bring about ignition.

Upward operation of the operating knob 73 is possible only when the cap 63 is open. The operating knob 73 is connected to a safety operation rod 74. A leg 75 is secured to the inner surface of a cap 63. When the cap 63 is closed, the upper end surface of the safety operation rod 74 abuts the lower end surface of the leg 75, making upward operation of the operating knob 73 impossible. With the cap 63 closed, the outer cylinder 61 is downwardly urged by the projection 63*a* formed on the inner side of the cap 63. The air hole 64 of the lower cylinder 61*b* is moved out of alignment with the air supply hole 60 and the notch 68*a*, so that air will not be supplied to the catalyst layer 65. Since the operating knob 73 is locked when the cap 63 is closed, spontaneous ignition of the lighter is prevented and the lighter can be safely carried and used.

Figure 12:
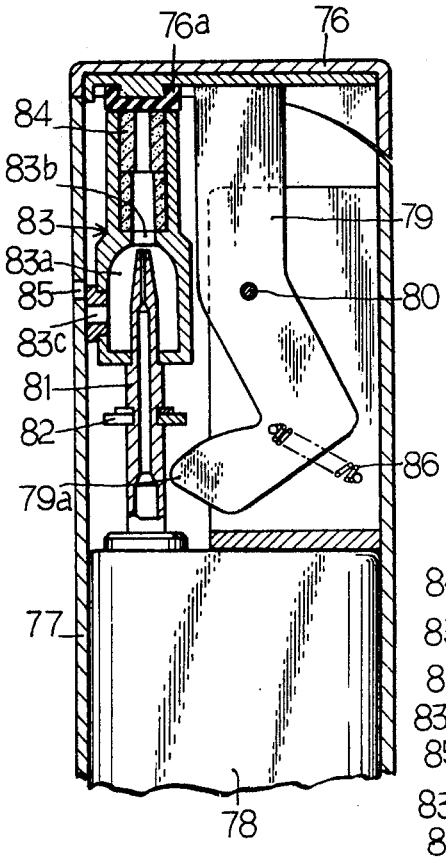
FIGS. 12 and 13 are fragmentary sectional views showing a further example of the ignition means within a cigarette lighter according to the invention.
Figure 13:
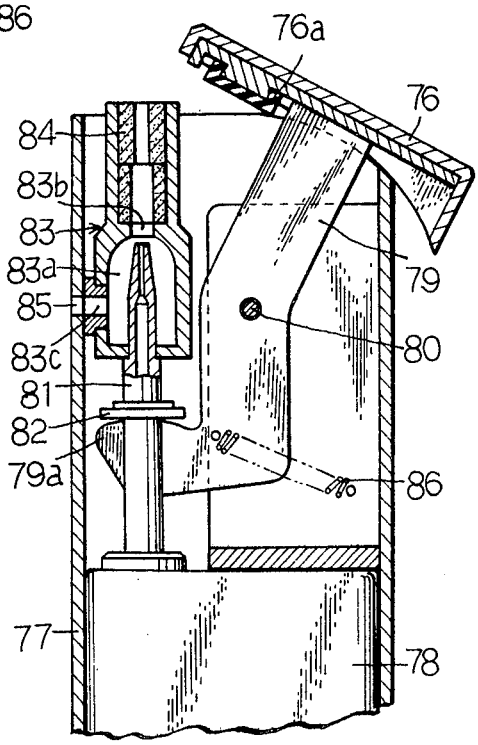

FIGS. 12 and 13 show another embodiment of a cigarette lighter, in which the air supply to the catalyst layer and control of the gas are interlocked to the opening and closing of a cap 76. A leg 79, rigidly connected to a cap 76, is pivoted at a pin 80. The leg 79 has an engagement portion 79*a* at its lower end. When the cap 76 is rotated in the clockwise direction to its open position, the engagement portion engages the lower surface of a washer 82 connected to a nozzle tube 81 extending from a fuel tank 78 and thus raise the nozzle tube 81. Raising the nozzle tube 81 starts the flow of fuel.

The nozzle tube 81 enters the bottom of a cylindrical section 83. The nozzle tube 81 extends into the interior space of the cylindrical section 83 and terminates facing a passage 83*b* leading to the catalyst layer 84. The cylindrical section 83 has an air intake hole 83*c* in its side normally out of alignment with an air supply window 85. A catalyst layer 84 is contained in the upper portion of the cylindrical section.

By rotating the cap 76 aside about the support 80 the nozzle tube 81 is raised to start the delivery of the gasified fuel. At the same time, the cylindrical section 83 is moved upward to provide communication between an air intake hole 83*c* and an air supply window 85.

After using the lighter, the cap 76 is restored by a coil spring 86 mounted at the lower end of the leg 79. This ensures that the cap 76 remains locked during non-use of the lighter. The catalyst layer 84 in the cylindrical section 83 is sealed by a seal member 76*a* on the cap 76. Further, the catalyst layer 84 may consist of a plurality of short cylinders stacked one above another each having a central passage, as shown in FIG. 10, and it may be removably mounted.

The gas lighter shown in FIG. 12 draws air into the flowing gas in the same manner like that in FIG. 10.

While the description has been made in conjunction with the accompanying drawings, it will be understood that the above embodiments are by no means limitative but various modifications and alterations may be considered by one skilled in the art without departing from the scope of the subject matter of the invention.

What is claimed is:

1. A fuel gas lighter of the type using a catalyst to elevate the temperature of at least a portion of the gas flow to ignition temperature comprising:

(a) fuel storage means in said lighter;
(b) a nozzle;
(c) control means for controlling the flow of fuel to said nozzle;
(d) conduit means for delivering the fuel from said control means to said nozzle;
(e) means in said conduit means for gasifying the fuel;
(f) said means for gasifying comprising at least one restricting and expanding means;
(g) suction means in said conduit means actuated by the flow of fuel therein for drawing in air and mixing said air and fuel together; and
(h) a catalyst mounted within said lighter (i) means for passing at least part of said fuel and air mixture in contact with said catalyst whereby the temperature of the fuel and air mixture is raised to ignition temperature.

2. The lighter recited in claim 1 further comprising:
(a) said restricting means being an orifice through which said fuel passes;
(b) said expanding means being a portion of said conduit means immediately downstream of said restricting means; and
(c) said expanding means having a cross-sectional area much larger than said orifice.

3. The lighter recited in claim 1 wherein said at least one restricting and expanding means comprises:
(a) a first orifice in said conduit means through which said fuel passes;
(b) a first portion of said conduit means immediately downstream of said first orifice, said first portion having a first cross sectional area much larger than said first orifice;
(c) at least a second orifice downstream of said first portion;
(d) at least a second portion of said conduit means immediately downstream of said at least a second orifice, said at least a second portion having a second cross sectional area much larger than said at least a second orifice; and
(e) said second portion having a cross sectional area greater than said first portion.

4. A fuel gas lighter of the type using a catalyst to elevate the temperature of at least a portion of the gas flow to ignition temperature comprising:
(a) fuel storage means in said lighter;
(b) a nozzle;
(c) control means for controlling the flow of fuel to said nozzle;
(d) conduit means for delivering the fuel from said control means to said nozzle;
(e) means in said conduit means for gasifying the fuel;
(f) suction means in said conduit means actuated by the flow of fuel therein for drawing in air and mixing said air and fuel together;
(g) a catalyst mounted within said lighter
(h) a catalyst container containing said catalyst;
(i) a plurality of tubes in said catalyst container;
(j) said catalyst being porous and substantially filling said tubes; and
(k) means for passing at least part of said fuel and air mixture into contact with said catalyst contained in said tubes, whereby the temperature of the fuel and air mixture is raised to ignition temperature.

5. The lighter recited in claim 4 wherein said plurality of tubes are of heat resistant glass.

6. A fuel gas lighter of the type using a catalyst to elevate the temperature of at least a portion of the gas flow to ignition temperature comprising:
(a) fuel storage means in said lighter;
(b) a nozzle;
(c) control means for controlling the flow of fuel to said nozzle;
(d) conduit means for delivering the fuel from said control means to said nozzle;
(e) means in said conduit means for gasifying the fuel;
(f) suction means in said conduit means actuated by the flow of fuel therein for drawing in air and mixing said air and fuel together;
(g) a catalyst mounted within said lighter;
(h) means for passing at least part of said fuel and air mixture into contact with said catalyst whereby the temperature of the fuel and air mixture is raised to ignition temperature;
(i) a nozzle tube having a first cross sectional area in said conduit means;
(j) a chamber having a second cross sectional area immediately downstream of said nozzle tube;
(k) said second cross sectional area being much larger than said first cross sectional area; and
(l) air duct means for communicating air to said chamber.

7. The lighter recited in claim 6 further comprising sealing means for substantially sealing said air duct means when the lighter is not in use.

8. The lighter recited in claim 7 wherein said sealing means is operatively connected to said control means.

9. A fuel gas lighter of the type using a catalyst to elevate the temperature of at least a portion of the gas flow to ignition temperature comprising:
(a) fuel storage means in said lighter;
(b) a nozzle;
(c) control means for controlling the flow of fuel to said nozzle;
(d) conduit means for delivering the fuel from said control means to said nozzle;
(e) means in said conduit means for gasifying the fuel;
(f) suction means in said conduit means actuated by the flow of fuel therein for drawing in air and mixing said air and fuel together;
(g) a catalyst mounted within said lighter;
(h) means for passing at least part of said fuel and air mixture into contact with said catalyst whereby the temperature of the fuel and air mixture is raised to ignition temperature;
(i) a catalyst holder adjacent the end of said nozzle;
(j) resilient means for urging said catalyst into said catalyst holder and for retaining it enclosed therein; and
(k) means actuated by said control means for urging said catalyst at least partly out of said catalyst holder and into contact with the fuel and air mixture from said nozzle.

10. The lighter recited in claim 9 further comprising:
(a) an elastic membrane substantially sealing said catalyst from the air when enclosed in said holder;
(b) an opening in said membrane; and
(c) said means for urging said catalyst being operative to force said catalyst through said opening.

11. A fuel gas lighter comprising:
(a) a fuel tank for liquid fuel;
(b) a nozzle having an outlet;
(c) conduit means for connecting fuel from said fuel tank to said nozzle;
(d) restricting and expansion means in said conduit means for gasifying said fuel;
(e) venturi means in said conduit means for drawing in air and mixing it with the fuel;
(f) a catalyst container;
(g) a body of catalyst in said catalyst container;
(h) means for passing part of said fuel and air mixture in contact with said catalyst;
(i) outlet means in said catalyst container for permitting the fuel and air mixture to leave said catalyst container;
(j) said outlet means being adjacent the outlet of said nozzle whereby ignited fuel and air from said catalyst container is operative to ignite the fuel and air mixture from said nozzle outlet;
(k) control means for controlling the flow of fuel from said fuel tank into said conduit means; and
(l) means for substantially sealing said body of catalyst from air when said lighter is not in use.

* * * * *